US011466567B2

(12) United States Patent
Harrigan et al.

(10) Patent No.: US 11,466,567 B2
(45) Date of Patent: Oct. 11, 2022

(54) HIGH FLOWRATE FORMATION TESTER

(71) Applicant: Halliburton Energy Services, Inc., Houston, TX (US)

(72) Inventors: Edward Harrigan, Richmond, TX (US); Matthew L. Lee, Tomball, TX (US); Ameet B. Agnihotri, Cypress, TX (US); Charles Wilton Seckar, Katy, TX (US); Christopher Michael Jones, Katy, TX (US); Nestor Javier Rodriguez, Shenandoah, TX (US); Darren George Gascooke, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 72 days.

(21) Appl. No.: 16/930,657

(22) Filed: Jul. 16, 2020

(65) Prior Publication Data

US 2022/0018249 A1 Jan. 20, 2022

(51) Int. Cl.
*E21B 49/10* (2006.01)
*E21B 49/00* (2006.01)
(Continued)

(52) U.S. Cl.
CPC ..... *E21B 49/10* (2013.01); *E21B 47/008* (2020.05); *E21B 47/06* (2013.01); *E21B 49/008* (2013.01)

(58) Field of Classification Search
CPC ..... E21B 47/008; E21B 49/088; E21B 49/10
See application file for complete search history.

(56) References Cited

U.S. PATENT DOCUMENTS 5,337,821 A * 8/1994 Peterson ..... E21B 47/10 175/48
5,540,280 A * 7/1996 Schultz ..... E21B 27/02 166/264

(Continued)

FOREIGN PATENT DOCUMENTS

CN 204677196 U 9/2015

OTHER PUBLICATIONS

PCT Application Serial No. PCT/US2020/042607: ISR: dated Apr. 8, 2021, 3 pages.

(Continued)

*Primary Examiner* — John Fitzgerald
(74) *Attorney, Agent, or Firm* — Delizio, Peacock, Lewin & Guerra

(57) ABSTRACT

A formation tester consists of an upper assembly, an impeller unit, a straddle packer unit, and an inverted reservoir description tool string. The upper assembly seals off the wireline cable at the rig and connects the wireline cable to the formation tester. The impeller unit includes an upper turbine which converts hydraulic power from circulation of drilling mud into mechanical power. The mechanical power is used to drive a lower impeller which is capable of pumping formation fluids at high flow rates. The straddle packer unit isolates a portion of the formation tester which is open to the borehole to allow entry and exit of formation fluids through the formation tester. The inverted reservoir description tool string contains a combination of formation description modules which are inverted from traditional reservoir description tool modules to allow fluid flow paths to bypass electrical components.

8 Claims, 6 Drawing Sheets

(51) Int. Cl.
*E21B 47/008* (2012.01)
*E21B 47/06* (2012.01)

(56) References Cited

U.S. PATENT DOCUMENTS

| | | | | |
|---|---|---|---|---|
| 5,555,945 | A * | 9/1996 | Schultz | E21B 33/1243 166/250.07 |
| 5,799,733 | A * | 9/1998 | Ringgenberg | E21B 43/121 166/147 |
| 5,803,186 | A * | 9/1998 | Berger | E21B 49/008 166/264 |
| 6,325,146 | B1 | 12/2001 | Ringgenberg et al. | |
| 6,446,719 | B2 | 9/2002 | Ringgenberg et al. | |
| 6,446,720 | B1 | 9/2002 | Ringgenberg et al. | |
| 6,527,052 | B2 | 3/2003 | Ringgenberg et al. | |
| 6,729,398 | B2 | 5/2004 | Ringgenberg et al. | |
| 7,021,375 | B2 | 4/2006 | Ringgenberg et al. | |
| 7,073,579 | B2 | 7/2006 | Ringgenberg et al. | |
| 7,086,463 | B2 | 8/2006 | Ringgenberg et al. | |
| 7,594,541 | B2 * | 9/2009 | Ciglenec | E21B 49/10 700/282 |
| 7,654,321 | B2 | 2/2010 | Zazovsky et al. | |
| 8,109,157 | B2 * | 2/2012 | Kanayama | E21B 49/10 73/863.72 |
| 8,528,394 | B2 | 9/2013 | Eriksen | |
| 8,763,696 | B2 | 7/2014 | Bedouet et al. | |
| 9,309,748 | B2 * | 4/2016 | Gadot | E21B 47/09 |
| 10,107,096 | B2 | 10/2018 | Bedouet et al. | |
| 10,989,026 | B2 * | 4/2021 | Al-Gouhi | E21B 41/0085 |
| 2009/0175737 | A1 | 7/2009 | Intelisano | |
| 2014/0174733 | A1 * | 6/2014 | Gadot | E21B 47/007 166/264 |
| 2014/0224474 | A1 | 8/2014 | Cernosek et al. | |
| 2016/0237814 | A1 * | 8/2016 | Fripp | E21B 43/121 |
| 2019/0040740 | A1 | 2/2019 | Bedouet et al. | |
| 2021/0003003 | A1 * | 1/2021 | Proett | E21B 49/08 |
| 2021/0148202 | A1 * | 5/2021 | Al-Gouhi | E21B 41/0085 |
| 2022/0003087 | A1 * | 1/2022 | McMullen | E21B 47/008 |
| 2022/0065081 | A1 * | 3/2022 | Wrighton | H02K 5/1675 |

OTHER PUBLICATIONS

PCT Application Serial No. PCT/US2020/042607; Written Opinion: dated Apr. 8, 2021, 4 pages.

* cited by examiner

HIGH FLOWRATE FORMATION TESTER

TECHNICAL FIELD

The disclosure generally relates to the field of earth or rock drilling and the equipment for testing subterranean formation fluids, pressures, and formation fluid communication between and in zones and pores of subterranean formations.

BACKGROUND

Formation testing helps characterize a formation surrounding a well by measuring pressure dynamics in response to flow, capturing formation fluid samples, determining the composition of oil or gas in a formation, estimating the oil and gas recovery potential of the formation, estimating the size of the fluid bearing formation and/or estimating the connectivity of different formations within the well or between wells. Formation testing may be performed throughout many phases in the life of a well, such as exploration, development, production, and injection stages. Drill stem tests (DSTs) are a type of formation test that are typically conducted shortly after a well has been drilled in the formation. DST systems characterize reservoir flow and detect bed boundaries in the formation. A DST tool is placed near a zone of interest and the wellbore is sealed above and below the DST tool to analyze well flow and pressure. The information obtained from a DST can be used to estimate reserves, optimize reservoir development, and maximize production. A typical DST requires one to two weeks of rig time to obtain measurements.

BRIEF DESCRIPTION OF THE DRAWINGS

Embodiments of the disclosure may be better understood by referencing the accompanying drawings.

DESCRIPTION OF EMBODIMENTS

Figure 1:
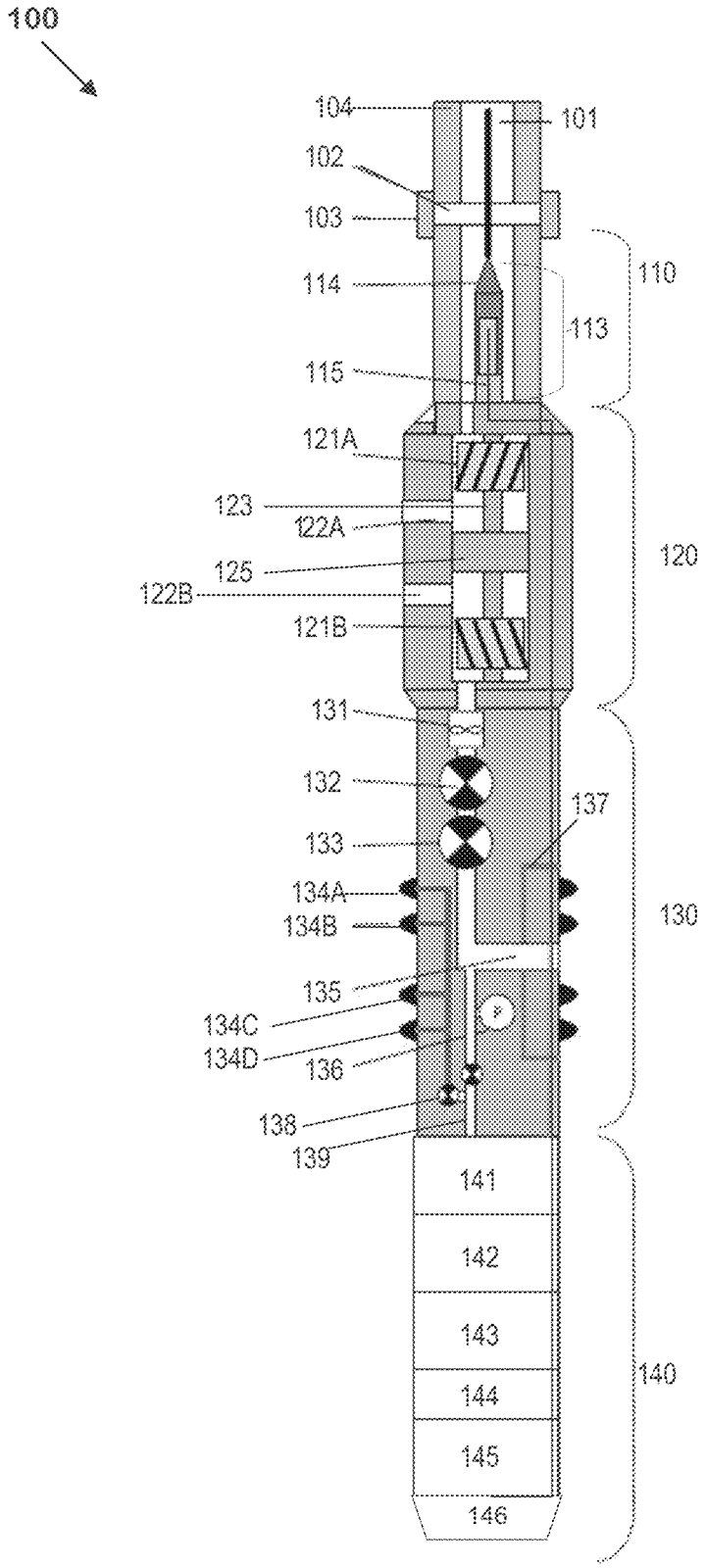
FIG. 1 is a schematic view of a high flowrate formation tester.

The description that follows includes example systems, methods, techniques, and program flows that embody embodiments of the disclosure. However, it is understood that this disclosure may be practiced without these specific details. For instance, this disclosure refers to high flowrate formation testers on land in illustrative examples. Embodiments of this disclosure can be also applied to offshore rigs and subsea wellbores. In other instances, well-known instruction instances, protocols, structures, and techniques have not been shown in detail in order not to obfuscate the description.

Overview

Formation testing can involve using many types of measurement tools to characterize reservoirs. Drill stem test (DST) tools are used to determine productive capacity and permeability of a formation by characterizing reservoir flow and detecting bed boundaries of interest tens or even hundreds of meters away from the wellbore. However, obtaining information from DSTs often requires one to two weeks or more of costly rig time. Wireline formation tester (WFT) tools are another option for performing in-situ formation tests. While WFTs require less rig time, existing WFT tools have limited reservoir flowrates (typically less than 1 gal/min) due to the electrical limitations associated with transmitting power via the wireline cable, the power efficiency of the downhole technology, and difficultly dissipating heat generated by pumps and motors in the wellbore. As a result, WFTs typically have a short depth of investigation into the reservoir. "While drilling" formation testing tools, such as measurement while drilling (MWD) or logging while drilling (LWD) tools, are another characterization tool. These tools often use turbines to generate electrical power downhole which can be used to drive a downhole pump. However, the efficiency of these systems limits the maximum available pumping power, and the heat dissipated by the electromechanical systems is difficult to dissipate to the wellbore. Each of these formation characterization tools provides valuable information, but can incur significant costs in terms of time, money, and efficiency.

A formation testing system (FTS) is disclosed which performs DST operations using a WFT tool and a drill pipe conveyance tool pushing system. The FTS incorporates a wireline deployed high flowrate formation tester. A drill pipe conveyance tool pushing system, in which a drill pipe connects to an upper portion of the WFT tool, assists the tool's movement down the wellbore. This provides control over the tool's location in highly deviated and horizontal wells, prevents the tool string from becoming stuck in the wellbore with wireline deployment, provides a means of delivering power and cooling to the downhole tools by circulating fluids, and provides a means of circulating to the surface any produced hydrocarbons during the test. The formation tester consists of an upper assembly, an impeller unit, a straddle packer unit, and an inverted reservoir description tool string. The upper assembly has a slip ring which decouples the WFT from the drill pipe to prevent movement of the drill pipe causing movement of the WFT when the packers have been set. The upper assembly also contains a connecting latch which creates an electrical connection between the wireline cable assembly and the top of the WFT, as will be familiar to those skilled in the art of pipe conveyed logging tools. The impeller unit includes an upper turbine (impeller) which converts hydraulic power from circulation of drilling mud into mechanical power. The mechanical power is used to drive a lower impeller which is capable of pumping formation fluids at high flow rates. The double impeller system used in the impeller unit avoids the need for conversion of mechanical power into electrical power, resulting in a higher formation pumping power and higher overall system efficiency. Heat dissipation from power loss is more manageable than conventional pumps used in WFTs because the power dissipating components are directly embedded in the fluid path, which conducts away generated heat. The straddle packer unit isolates a portion of the formation which is open to the borehole to allow entry and exit of formation fluids through the formation tester. The inverted reservoir description tool contains a combination of formation analysis and fluid sampling modules. These modules are inverted from traditional reservoir description tool modules to allow existing technologies to be deployed while avoiding the need to provide a high-volume fluid path through the WFT modules. This high flowrate formation tester reduces rig time and provides a deeper investigation of reservoir bed boundaries compared to standard formation testers.

Example Illustrations

FIG. 1 is a schematic view of a high flowrate formation tester. Formation drawdown and buildup tests are limited by the pumping flow rate capacity of the DST tool. A pressure pulse is produced by drawing a volume of fluid from the formation into the DST tool. This creates a pressure drop in the reservoir near the tool. As the reservoir replenishes the fluid and equalizes pressure across the formation, the DST tool measures pressure of the formation. To measure greater depths into a subterranean formation, a larger pumping flowrate capacity is needed. The formation tester 100 performs DST operations using a WFT tool and a drill pipe conveyance tool pushing system. In a drill pipe conveyance tool pushing system, the drill pipe connects to an upper portion of the WFT tool. As new drill pipe segments are added at the surface, the drill pipe pushes the tool through the borehole. When the WFT is close to the desired depth in the wellbore, the upper latch assembly and wireline cable are pumped down the center of the drill pipe and connect to the top of the wireline tool assembly, establishing electrical connectivity, communications and providing electrical power to the inverted WFT tool. A new impeller system, packer assembly, and reservoir description tool arrangement combined with existing DST tool features allow for a larger flowrate and increased resolution in pressure change measurements. The formation tester consists of four units: an upper assembly 110, an impeller unit 120, a packer unit 130, and an inverted reservoir description tool string 140.

The upper assembly 110 serves as a connection between a wireline 101, a drill pipe conveyance tool pushing system, and the formation testing equipment of the formation tester 100. The upper assembly connects the formation tester 100 to a drill pipe 104 through a drill pipe connection 102 and a slip joint 103. The slip joint 103 may be a standard slip joint or a compensated slip joint. The slip joint 103 decouples the upper assembly 110 from the drill pipe 104 to allow for rig heave and thermal expansion. A packer assembly may be used to seal around the wireline 101 at a rig. By sealing the wireline at a rig, a side entry sub-packer typically used in wireline tool pusher operations is not necessary, but a side entry sub-packer may be incorporated if multiple well tests per trip are desired. This is possible since a well test will typically only be performed at one depth per trip in the well. A downhole latch 113 attaches to the wireline 101 through a tool pusher wet-connect latch 114. The wet-connect latch 114 is pumped downhole once the formation tester is positioned at the desired depth. The wet-connect latch 114 includes conductors which allow wires to be routed through the assembly to the bottom of the string. A power and telemetry bus 115 runs from the downhole latch 113 through the other units of the formation tester 100.

In addition to the embodiment shown in FIG. 1, the upper assembly 110 may also include flapper gate check valves. These valves could be incorporated between the wet-connect latch 113 and the impeller unit 120. Flapper gate check valves are typically two valves connected in series. The flapper gate check valves would be configured to be open when fluid is pumped down the center of the pipe as well as when fluid is pumped up and out through the annulus. In a well control situation, if the pressure of the annulus rises above the pressure in the pipe, the flapper gate check valves would automatically close to prevent fluid from flowing to the surface through the center of the pipe.

Downhole from the upper assembly 110 is an impeller unit 120, the impeller unit 120 coupled to a downhole end of the upper assembly 110. The impeller unit 120 has electrical connections suitable for routing the wireline conductors through the impeller unit 120 to lower portions of the tool string. These connections may include bulkheads or feedthroughs suitable for maintaining a reliable connection under downhole conditions. A shaft carrying the conductors (not shown) may be filled with air or oil at atmospheric pressure or compensated borehole pressure. The impeller unit 120 has two impellers: 1) an upper impeller 121A and 2) a lower impeller 121B. The upper impeller 121A may be configured as a turbine blade or like a mud motor in which a decentralized rotating output shaft is connected to a centralized output shaft through a universal joint allowing for a fixed displacement per gallon of circulated fluid. These upper impeller configurations also allow for a debris tolerant design. The upper impeller 121A converts hydraulic power to mechanical rotational power. The upper impeller 121A provides a mechanical torque generated from the rotational power to drive the lower impeller 121B. The lower impeller 121B pumps fluid from the formation tester 100 through exit ports 122A and 122B into an annulus of the drill pipe using the converted power. The lower impeller 121B may be a turbine blade, a fixed displacement mud motor system, or any kind of pump architecture suitable for pumping downhole fluids. The lower impeller 121B may also be a multistage design similar to pumps used for artificial lift operations.

The upper impeller 121A and lower impeller 121B are directly coupled to each other through a rotating shaft 123. The upper impeller 121A drives the shaft 123 using the mechanical rotational power. The shaft 123 is mounted on a bearing assembly that is suitable for downhole environmental conditions as well as various torques exerted by the upper impeller 121A during operation. The bearings may be at the upper end of the shaft, the lower end, at both ends, in the center of the shaft, or some combination thereof. The rotational speed of the shaft 123 is a function of the flowrate of circulated fluid pumped from the surface, the properties of the fluid, such as viscosity or fluid density, the pitch of the impellors and/or mechanical design of the mud motor, and the overall efficiency of the system. The pumping rate of the fluid can be controlled by altering surface fluid pumping rates, impeller ratios for each impeller, and/or using different impeller designs. For example, impeller ratios can be altered by varying flow rates and pressures exerted on the impellers. The impeller design can be selected based on desired response. Changing the number of stages (blades) or the pitch of the blades changes the coupling ratio between the two impellers.

A diverter 125 surrounds the shaft 123. While the diverter 125 is shown in FIG. 1 as positioned longitudinally between the exit ports 122A and 122B, other configurations are also possible. The diverter 125 may have a rotary seal, bearing, or a clearance that allows the shaft 123 to pass through and connect the two impellers. The diverter 125 separates the upper impeller 121A and the lower impeller 121B. This allows flow from circulation fluids (mud pumped down from the surface) and flow from the formation (formation fluids) to be directed to the exit ports 122A and 122B. While the diverter 125 may or may not include a seal to separate the fluids in the impeller unit 120, the fluids comingle at the exit ports and in the annulus where both fluids can flow to the surface.

The packer unit 130 provides isolation of one portion of the borehole from the rest of the borehole. The packer unit 130 is surrounded circumferentially by one or more packers, such as packer 134A-134D. While FIG. 1 depicts four packers, any number of one or more packers may be used to provide adequate isolation of a portion of the borehole. The packers may be inflation packers, compression packers, or any other sealing technology capable of isolating a portion of a sand face or casing from the rest of the borehole. The packers 134A-134D are depicted in FIG. 1 as being hydraulically connected, but each packer 134A-134D may also be individually inflated and isolated using separate valves. The packer unit has a bypass line 137 which hydraulically equalizes the pressure above and below the packer 134A-134D in the borehole. The bypass line 137 prevents buildup of axial forces on the packed off assembly after the packers are inflated against the borehole. The packer unit 130 may be able to empty the packers 134A-D of their inflation fluid in the event of a power loss or after an overpull on the pipe for emergency retrieval to the surface. A flowline 139 ka second flowline) connects to an isolation valve 138 to control inflation of the packers 134A-134D. The packer unit 130 is electrically connected to the rest of the tool string. This allows access to electrical power for sensors as well as receiving controls and communications from the surface. The packer unit 130 may contain electrical terminators at the end of communication lines, as typical in wireline tool strings.

The packer unit 130 has a large interval flowline 135 (a first flowline) to allow fluid to flow into the formation tester 100 from the reservoir. When fluid is flowing through the flowline 135, the flowline 135 provides a large diameter flowline passage between the packer unit 130 and the impeller unit 120. The flowline 135 has minimal bends and/or restrictions to facilitate high flow with low pressure loss. The flowline 135 has a much larger diameter than typical formation tester tool flowlines. The flowline diameter may be up to two inches. Increasing the diameter of the flowline 135 can increase the flow rate by up to a factor of 20 over flowlines in typical Wireline Formation Testers. For example, a typical flowline diameter is one-quarter inch. The flowline 135 at a 1-inch diameter produces a flow rate sixteen times greater than the typical one-quarter inch flowline. The flowline 135 is suitable for high flowrates of 10 gal/min or higher.

The packer unit 130 houses multiple sensors, valves, and gauges for controlling fluid flow and obtaining measurements. The packer unit may include a flowrate sensor 131, such as a spinner or counter. The flowrate sensor 131 measures flowrate of fluids in the packer unit. In an example embodiment with a counter as the flowrate sensor 131, the counter may count rotations of the shaft 123 in the impeller unit 120. The sensor may be any suitable device for measuring flowrate of reservoir fluids in a downhole environment. A metering or throttling valve 132 receives signals from the flowrate sensor 131 through a microcontroller. Based on the signals, the microcontroller will provide commands to the throttling valve 132 to fine tune the flowrates. The commands to the throttling valve 132 may incorporate circulation rates to control reservoir flowrates in response to measured properties such as drawdown pressure, flowrate, and/or bubble point detection. The commands to the throttling valve may be part of a feedback loop to continuously adjust flowrates based on current downhole conditions.

The packer unit 130 has a shut-in valve 133 which is suitable for isolating the packer unit 130 from the rest of the formation tester 100 and from the wellbore. The shut-in valve 133 may be a ball valve or any similar design, such as those used in standard DST tools. The shut-in valve 133 allows reservoir fluids to be contained, or "shut-in", in the packer unit 130 after flowing for a period of time in order to monitor the rise in reservoir pressure at the end of the DST. The shut-in valve 133 may have a large orifice when open to facilitate rapid flow or closed to facilitate a small storage volume or "dead volume" between the valve and the formation once the fluid is shut in. Dead volume distorts pressure buildup measurements in DST tests since the volume of fluid in the tool and wellbore is not subject to the reservoir pore geometry but is still in pressure communication with it. Minimizing the dead volume decreases the time required to observe changes in reservoir pressure from reservoir pressure buildup. This reduces the measurement sensitivity to storage effects from the tool and wellbore system outside of the reservoir.

A pressure gauge 136 measures pressure in the formation tester 100, which is equalized to the reservoir pressure after drawdown. Changes in pressure buildup are indicative of reservoir permeability and are sensitive to reservoir boundaries, as will be familiar to those skilled in the art of reservoir permeability measurements. The pressure gauge 136 monitors fluid at an interval between the packers. The pressure gauge 136 has a high resolution to detect small changes in pressure with time at the end of buildup. The pressure gauge 136 may utilize a quartz resonator or any other suitable technology.

While the flowline 139 and the valve 138 serve to control the inflation and deflation of the packers 134A-134D, they also connect to the reservoir description tool string 140. The valve 138 connects the flowline 139 to the inside of the packer elements. This allows the packers to be inflated using a pump of the reservoir description tool string 140 and for taking fluid samples periodically before, during, or after formation testing. The reservoir description tool string 140 has a pump and one or more chambers available to collect samples of formation fluid. Fluids may be pumped into the sample chambers. The flow rate of fluid can be adjusted while the formation tester is deployed to alter the flow characteristics of the fluid into the chambers. These samples in the chambers can be contained and returned to surface to perform fluid identification and analysis uphole.

The bottom of the packer unit 130 is hydraulically and electrically connected to the inverted reservoir description tool string 140. The inverted reservoir description tool string 140 contains similar modules to a standard reservoir description tool string, but it has been inverted so that the end which normally goes uphole is at the distal end of the string. This allows power and telemetry cartridges, which normally do not include flowlines for fluid, to be out of the path of the large diameter fluid flowlines. This prevents the formation fluid from having to flow through the power and telemetry, pump, fluid analysis and sample chamber modules before reaching the exit ports, as occurs in traditional formation tester tools. Flowing through the additional modules of traditional formation testers limits the maximum flowrate of the system, due to the small diameter flowlines and small valve orifices present, which causes a larger pressure drop in the fluid and severely limits the maximum flowrate of the system. This also causes the formation tester to expend more energy and results in the dissipation of more heat. By inverting the formation tester components and enabling the bypassing of these modules, this formation tester is more efficient than traditional tools.

The inverted reservoir description tool string 140 is comprised of a combination of modules suitable for transporting, collecting, and identifying fluids. All of these are arranged "upside down" from their traditional operational deployment in standard wireline formation testing operations. A pump 141 can be used to pump fluids to inflate the packers 134, or to pump fluid from the flowline 135 through fluid identification module 142 and, when desired, into sample chambers 143. Additional modules include a fluid identification module 142, reservoir description tool string sample chambers 143, a power module 144 and a telemetry module 145. A special bull plug 146, combines the functions of a traditional wireline tool string bottom nose, and also routes the connections of the power and telemetry bus 115 through lines to the distal ends of the power and telemetry modules 144, 145 so that the reservoir description tool string 140 can receive power and communication from the surface system. The bull plug 146 is designed to facilitate conveyance of the entire string. While depicted as a bull plug, any device capable of closing off the end of tool string may be used. For example, an inverted wireline cable head or an inverted wireline logging head may be used. The formation tester 100 may also be equipped with standoffs, rollers, and/or jars to facilitate conveyance in the borehole.

Figure 2:
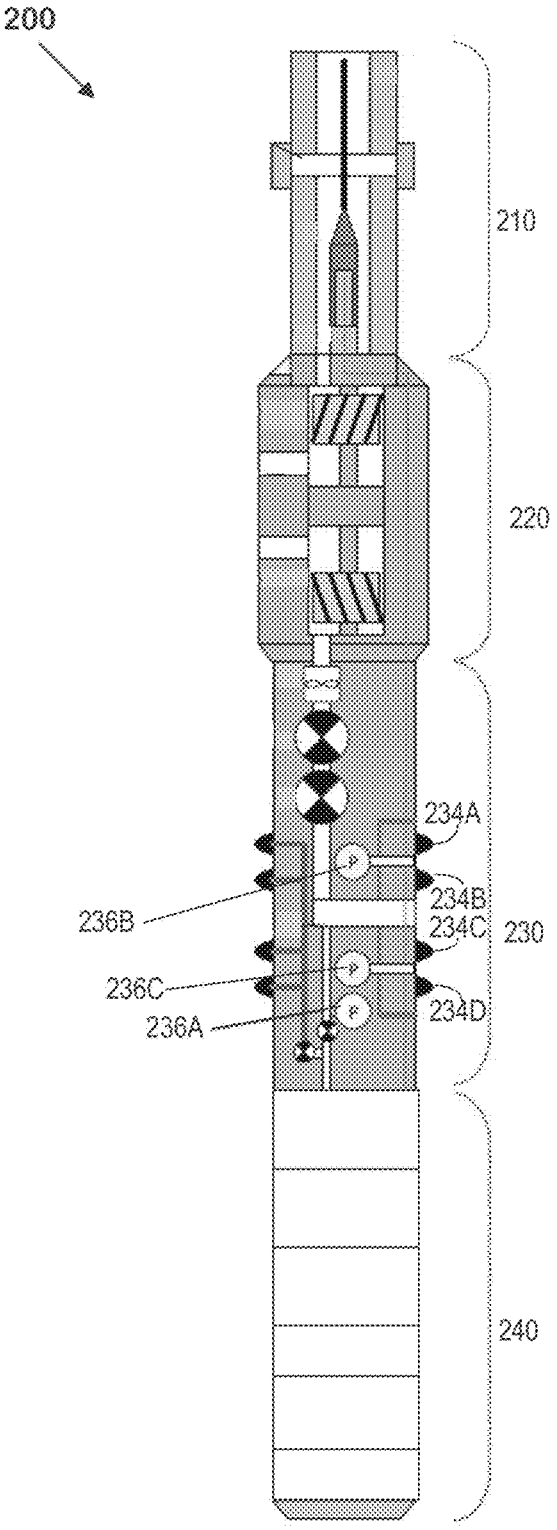
FIG. 2 is a high flowrate formation tester with additional pressure gauges for vertical interference testing.

FIG. 2 is a high flowrate formation tester with additional pressure gauges for vertical interference testing. The pressure gauges may be quartz or another technology, such as a strain gauge, a sapphire gauge, etc. FIG. 2 depicts a formation tester 200, similar to the formation tester 100 of FIG. 1. The formation tester 200 has an upper assembly 210, an impeller unit 220, and an inverted reservoir description tool string 240. Each of these units is substantially similar and contains similar elements to the upper assembly 110, the impeller unit 120, and the reservoir description tool string 140 described in FIG. 1. The formation tester 200 includes a packer unit 230. The packer unit includes all elements described in the packer unit 110230 with two additional pressure sensors. When additional pressure gauges are added to a formation tester, and hydraulically connected to other isolated portions of the reservoir, the formation tester can perform vertical interference tests along with DSTs. Vertical interference testing allows the formation tester to measure a pressure response to a large drawdown at a central position between the two pressure gauges. Vertical interference testing may be used to characterize additional properties of the reservoir such as vertical bed connectivity, vertical permeability, and/or anisotropy.

The packer unit 230 has four packers 234A-234D longitudinally spaced along the outside of the formation tester 200. A pressure sensor 236A is used to monitor pressure of fluid in the central interval. Alternatively, a separate pressure gauge (not shown) may be used to monitor the pressure in the packer elements for inflation and/or deflation. Two additional pressure sensors 236B and 236C are attached at interim intervals along the packer unit 230. The pressure gauge 236B is positioned between packers 234A and 234B while the pressure gauge 236C is positioned between the packer 234C and the packer 234D. The pressure gauges 236B and 236C are in hydraulic connection with a test interval or subsequent intervals. The pressure gauges 236B and 236C are preferably located at a known depth relative to the test depth and further on depth with each other within packer zones. While FIG. 2 depicts two pressure gauges 236B and 236C, a single pressure gauge may be used to perform a vertical interference test. The single pressure gauge may be above or below the central interval, in zonal isolation with central interval. The packer zones include a primary pump out depth, a buffer zone above the primary pump out depth, and a buffer zone below the primary pump out depth.

In another embodiment, the formation tester of FIG. 1 or FIG. 2 may reverse circulate drilling fluid by pumping fluids down the annulus and up the center of the pipe. In this embodiment, the lower impeller may be reversed so that fluid drawn from the reservoir is comingled with the circulated fluid and is pumped up the center of the drill pipe. This allows any produced oil and gas from the operation of the system to be contained in the pipe and results in a higher pressure in the annulus between the drill pipe and the open borehole section, which may be useful in some well control situations.

In yet another embodiment, the lower impeller in the impeller unit of FIG. 1 or FIG. 2 may be reversed so that it pumps borehole fluid down in response to circulation fluid being pumped down the center of the drill pipe. This allows the formation tester to perform small-scale fracturing, or a "mini-frac." As a mini-frac tool, the formation tester raises the pressure of the fluid in the packer interval above borehole pressure until the pressure induces a fracture in the formation. The sensors of the formation tester detect fracture initiation pressure, fracture closure pressure, and/or minimum stress. The formation tester controls the pumping rate to regulate the frac fluid flowrate. The ratio of impeller blades is selected based on a predetermined value of frac fluid flowrate as a function of circulation rate. The frac fluid flow rate is also a function of reservoir permeability before and after the frac is initiated. The sensors in the impeller unit measure the applied pressure and flowrate throughout the fracturing process and monitor pressure dynamics as the fracturing pressure is dropped, to detect fracture closing pressures. Modulating the position of the throttling and shut in valves based on the measurements allows for fine tuning of the pressure and flowrate dynamics. The pumps of the formation tester can achieve higher pressures and flowrates than is normally possible using a conventional downhole formation tester pump, which is limited by the available power in a wireline. Formation tester pumps are also susceptible to failure from mud solids in check valves. The probability of this failure mode is reduced since the formation tester does not require check valves in the fluid flow path.

Figure 3:
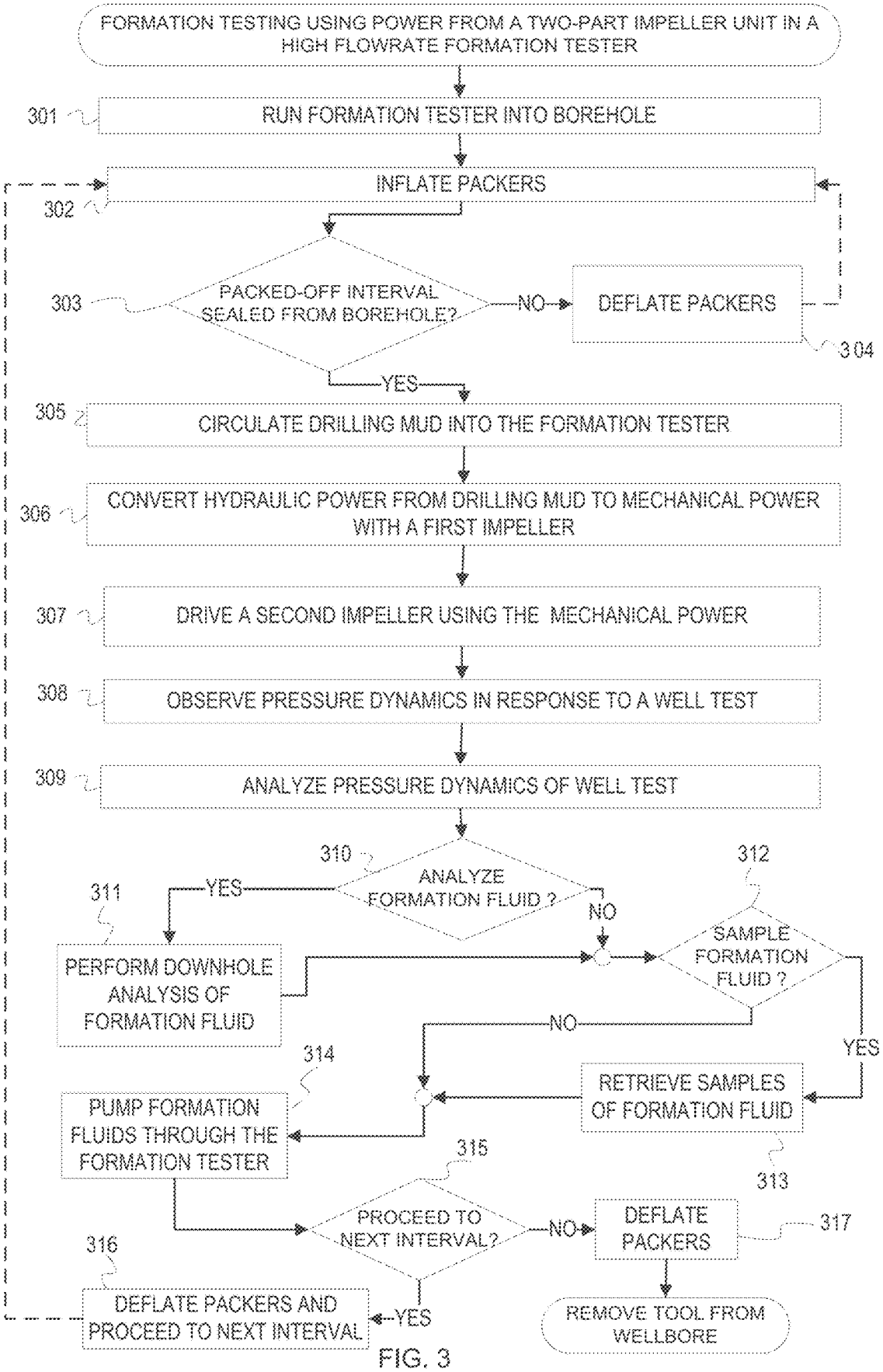
FIG. 3 is a flowchart of operations for formation testing using power transmitted from the surface using a two-part impeller unit in a high flowrate formation tester.

FIG. 3 is a flowchart of operations for formation testing using power transmitted from the surface using a two-part impeller unit in a high flowrate formation tester. Some of the operations of the flowchart can be performed by software, firmware, hardware or a combination thereof. The operations of the flowchart start at block 301.

At block 301, a high flowrate formation tester is run into a borehole. The high flowrate formation tester connects to a drill pipe section of a tool string which moves the formation tester down the borehole. After the tool string has been constructed on the surface and positioned at a desired depth, a wireline cable is run through the center of the drill pipe to attach to the formation tester. The wireline cable is sealed off at the surface, or via a conventional side entry sub. The wireline cable supplies electrical power from the surface to the formation tester.

At block 302, a control program initiates inflation of packers surrounding the formation tester to seal off and isolate a portion of the borehole from the rest of the borehole. Once an electrical connection is established between the control program and the sensors and actuators on the formation tester, the control program initiates inflation of the packers on the formation tester. An inflatable bladder may be used to expand the packer element against the borehole wall. The control program may be included in a module of the formation tester, in a device at the surface or in a combination thereof.

At block 303, the control program initiates a downhole drawdown test. After inflating the packers, the system performs a downhole drawdown test to ensure that the inflated packers have sealed the packed-off interval from the rest of the borehole. If the drawdown test results indicate the packed-off interval is sealed, operations continue to block 304. If not, operations proceed to block 304.

At block 304, the packers are deflated. Packers may fail to seal off the borehole interval due to various installation procedures, operational factors, and/or pressure differentials over the seal. While the packers are deflated changes may be implemented to correct the issues that caused the failure to seal. For example, the time allotted to inflate the packers or the maximum inflation of the packers may be adjusted. The high flowrate formation tester may also be repositioned while the packers are deflated. Operations return to block 302.

At block 305, the control program initiates circulation of drilling mud, or drilling fluid, into a formation tester. The control program initiates pumping of drilling fluid down the drill pipe from the surface. The control program controls the circulation rate of the drilling fluid by monitoring flowrate at the surface or using downhole sensors at the formation tester. The control program can maintain a predetermined circulation rate or adaptively update the circulation rate based on downhole conditions. When wireline systems are deployed on drill pipe, drilling fluid typically has a circulation rate of around 2-10 barrels per minute (bpm).

At block 306, a first impeller converts hydraulic power from the drilling fluid into mechanical power. The drilling fluid enters the formation tester through the upper assembly and encounters a first impeller. The pressure drop of the circulating drilling fluid across the blades of the first impeller applies a torque to the shaft. The rotational displacement of the impeller blades is a function of the flowrate of the circulating drilling fluid. The impeller assembly thus converts hydraulic power into rotational mechanical power. Input hydraulic power is the product of the pressure drop and flowrate across the impeller assembly and output mechanical power is a product of the torque and the angular velocity of the impeller.

At block 307, the mechanical power drives a second impeller. A shaft located longitudinally within the impeller unit connects the first and second impellers. One end of the shaft is coupled to the first impeller. As the first impeller rotates, the first impeller transfers the mechanical power to rotate the shaft. A second end of the shaft is coupled to the second impeller. The shaft transfers the mechanical energy from the first impeller to the second impeller.

At block 308, the formation tester performs a well test and observes pressure dynamics in response to the formation test. Reservoir fluid is induced to flow through the formation tester and into the wellbore for a period of time, while pressure at the sand face is monitored using the quartz gauge or gauges in the formation tester. This is followed by a "shut in" period, where flow ceases, and the pressure is monitored while it builds back up as the reservoir equalizes pressure in response to the pumped fluid event. Properties of the reservoir, including fluid mobility, reservoir permeability, anisotropy, bed boundaries and reservoir connectivity with other zones may be assessed.

At block 309, the formation tester analyzes pressure dynamics of the well test. The formation tester includes an inverted reservoir description tool string which contains modules for obtaining information about a well or reservoir. A pressure gauge in the formation tester, analyses the pressure transient response to a change in a production rate. Analyzing the pressure dynamics of a well test provides information on the productivity of the well and can be used to describe a reservoir. For example, analyzing the pressure dynamics may help determine well deliverability, evaluate well completion efficiency, and/or evaluate reservoir parameters.

At block 310, a formation analyzer of the formation tester determines if formation fluid is to be analyzed downhole in the current interval. Formation fluids may be analyzed downhole, at the surface, or both. The determination of whether or not to analyze fluid downhole for an interval may be based on time or distance traversed. As the formation tester moves downhole through the addition of drill pipe sections, the formation tester traverses many intervals. Not every interval traversed will be analyzed depending on the distance traversed, known properties of the formation, and desired number of samples analyzed. If the formation tester determines to analyze downhole formation fluids at the current interval, operations continue to block 311. If not, operations continue to block 312.

At block 311, the formation analyzer of the formation tester performs a downhole analysis of formation fluid. The formation tester measures quantitative fluid properties downhole to deliver a comprehensive characterization of reservoir fluids at reservoir conditions. Downhole fluid analysis may provide information on hydrocarbon composition of the formation fluid, gas/oil ratio, optical properties, chemical composition, and/or resistivity of reservoir fluid.

At block 312, the formation analyzer determines if a formation fluid sample should be collected at the current interval. Similar to the determination of block 310, formation samples may not be collected at every interval. Formation samples may be collected in conjunction with formation fluid analysis or each may be an independent operation. As such, operations of blocks 310 and 312 may be performed in sequential order as described, concurrently with each other, or independently when one is determined not to be performed while the other is determined to be performed. If the formation analyzer determines formation fluid samples are to be collected, operations continue to block 313. If not, operations continue to block 314.

At block 313, the formation tester retrieves samples of formation fluid. The second impeller pulls formation fluids out of the formation. The rotation of the second impeller creates a pressure differential across it, that results in a pressure differential between the formation pressure and the pressure in the formation tester and draws fluids from the formation into the formation tester. As the second impeller operates, the pressure drawdown created by the rotation of the impeller pulls formation fluids through the formation tester. The formation fluids travel through flowlines in the formation tester. These flowlines are connected via a downhole pump and fluid analysis modules to chambers for collecting samples of the formation fluids. These fluid analysis modules and sample chambers have sensors and valves which may be monitored and controlled from the surface allowing representative samples of the formation fluid to be analyzed downhole and/or brought to surface for surface analysis.

At block 314, a standard wireline formation tester downhole pump forces formation fluid through the inverted standard modules of the formation tester for sampling and/or analysis. Collected samples may be stored in the formation tester sample chambers and retrieved when the formation tester is removed from the borehole.

At block 315, a decision to proceed to the next interval is made. The decision to proceed to the next interval may be a manual process or and automatic process. The decision to proceed to the next interval may be made by an operator at the surface by deflating the packer elements, conveying the assembly to a different depth and redeploying the packers. The decision may be made based on a pre-determined testing plan or based on results from the previous tests. Results may include pressure dynamics, fluid analysis, sample acquisition or measured properties of fluid retrieved at the surface. This indication may be displayed on a device on the surface. The decision to proceed may also be automated based on time, analysis completion, and/or surface operation status. For decisions based on time, the formation analyzer may be programmed to proceed at a set time interval up to a predetermined maximum time. The maximum time may be based on the expected total operation time. For decisions based on analysis completion, the formation analyzer may be programmed to proceed after performing downhole analysis and/or retrieving samples. A decision of no for block 310 or block 312 is sufficient to indicate the respective analysis is complete. If the decision is made to proceed to the next interval, operations continue to block 316. If no, operations proceed to block 317.

At block 316, the packers are deflated. After formation analysis is finished for a zone, the formation tester can be moved to the next borehole interval. Operations return to block 302 with analysis performed for the new borehole interval. Operations of the flowchart of FIG. 3 may be repeated at multiple intervals to acquire additional formation information.

At block 317, the packers are deflated. This signifies the end of current operations, and the formation tester is removed from the wellbore.

Figure 4:
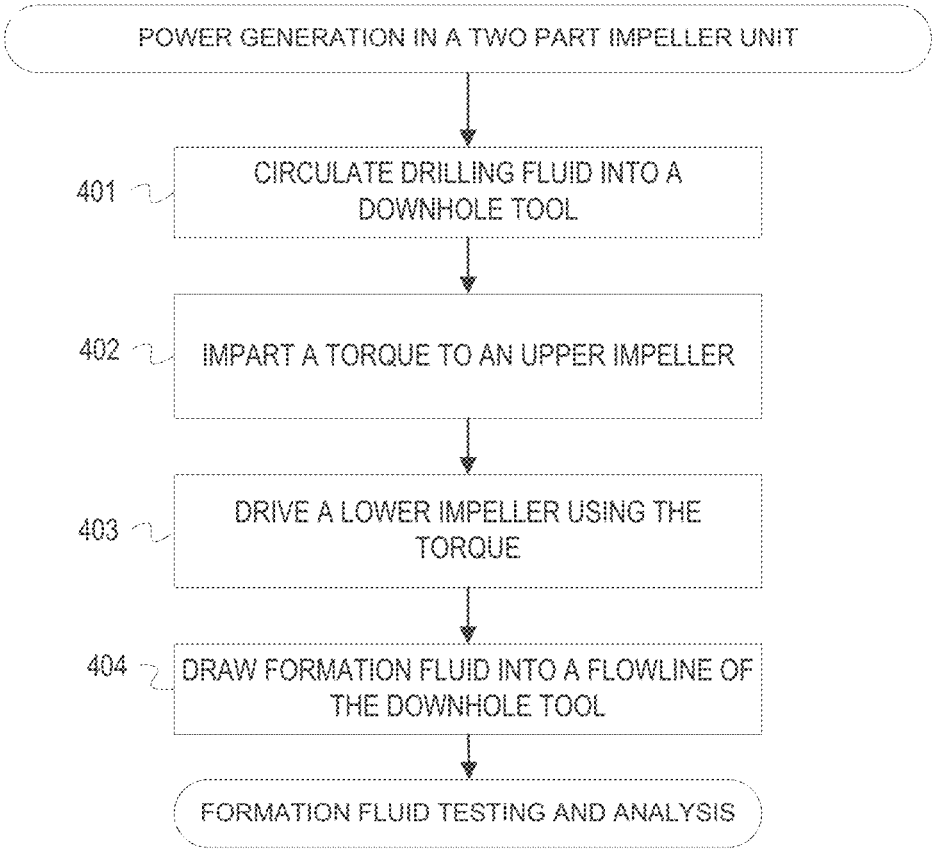
FIG. 4 depicts is a flowchart of operations for generating power using a two-part impeller unit.

FIG. 4 is a flowchart of operations for generating power using a two-part impeller unit. Some operations of FIG. 4 overlap with operations of FIG. 3. Similar operations will not be described in detail again. Operations of FIG. 4 begin at block 401.

At block 401, drilling fluid circulates into a downhole tool. A circulation system on a drilling rig at the surface of the wellbore allows for circulation of drilling fluid, or mud, down through the drill string. The circulation system may be a system of pumps, distribution lines, and storage tanks and/or pits that move drilling fluid from the surface into the borehole. The drilling fluid circulates into a downhole tool, such as the high flowrate formation tester of FIG. 1 or FIG. 2, through an opening in the tool. The drilling fluid enters the formation tester through the opening and encounters a first impeller.

At block 402, the circulating drilling fluid imparts a torque to an upper impeller. Similar to block 304 of FIG. 3, the upper impeller converts hydraulic power from the drilling fluid into mechanical power. The kinetic energy of the circulating drilling fluid applies a torque to the first impeller. The torque is determined by the pressure drop of the fluid across the impeller assembly and the displacement of the impeller blades by the flowrate of the circulating drilling fluid. Power produced by the upper impeller is a product of the torque and the angular velocity of the upper impeller assembly.

At block 403, a shaft mechanically couples the upper and lower impellers. As the upper impeller rotates, the upper impeller transfers the mechanical power to rotate the shaft. The shaft transfers the mechanical energy from the upper impeller to the lower impeller.

At block 404, the lower impeller draws formation fluid into a flowline of the downhole tool. The rotation of the lower impeller creates a pressure differential which pulls formation fluid into the downhole tool through a flowline that is open to the formation. Fluid in the downhole tool may be used for formation fluid testing and analysis. Sample of the formation fluid may be collected as the formation fluid is drawn through the flowline. Samples may be collected using downhole pumps and chambers or recesses off the flowline which create an area of decreased pressure along the formation fluid flow path. This causes the formation fluid to flow into a sample chamber or recessed area.

Figure 5:
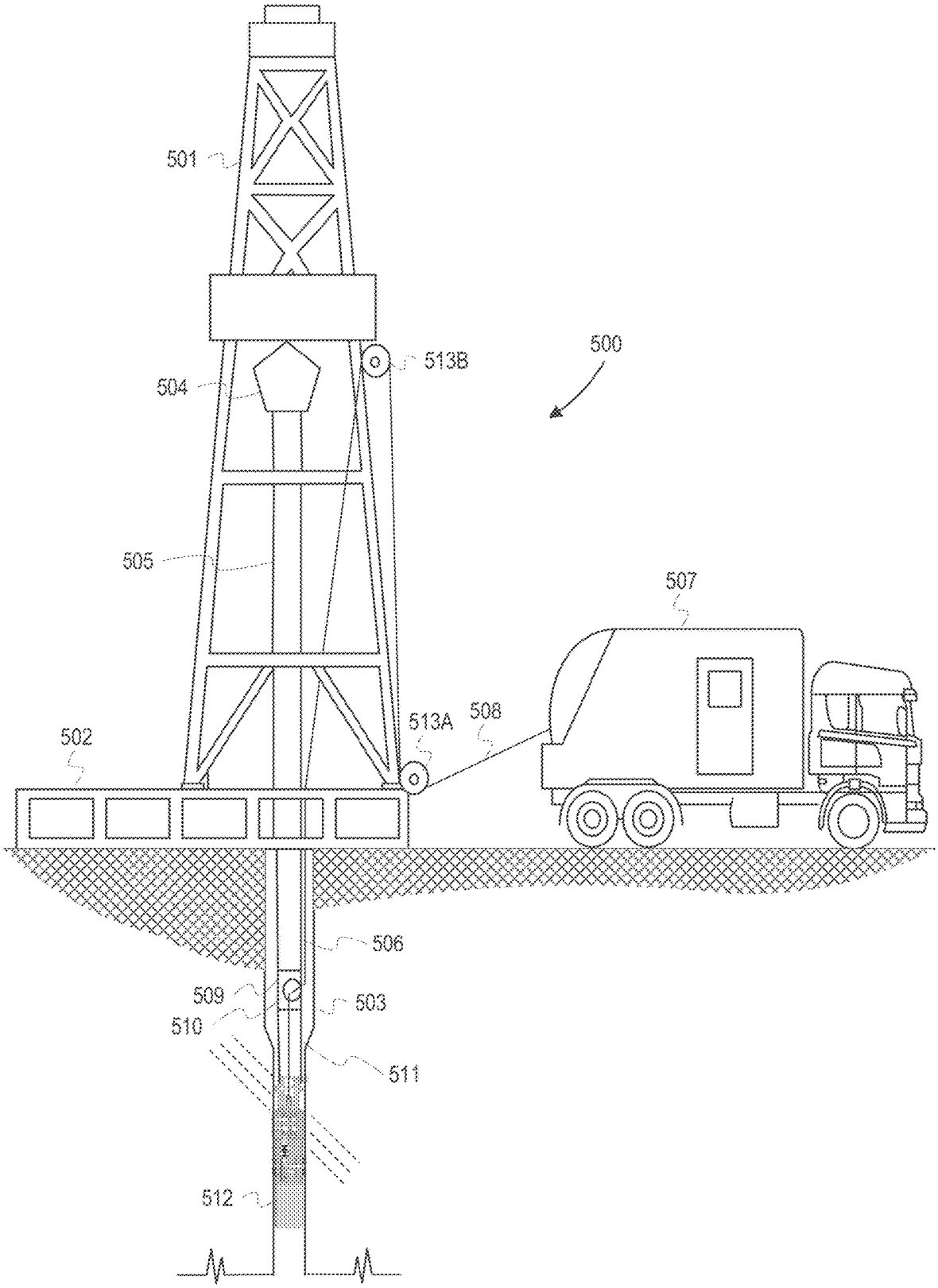
FIG. 5 depicts an example of a well with a pipe conveyed high flowrate formation tester.

FIG. 5 depicts an example of a well with a pipe conveyed high flowrate formation tester. A system 500 is used in an illustrative pipe conveyed logging environment, in accordance with embodiments of the present disclosure. The system 500 includes a derrick 501 and a rig floor 502. The derrick 501 houses a top drive 504 which aids in conveyance of drill pipe and downhole tools into a borehole 503. The top drive 504 drives drill pipe sections into the borehole. Multiple sections of drill pipe are connected and run in hole throughout logging. At the surface, a lower end of a drill pipe section 505 is connected to an upper end of a drill pipe section 506, which is in the borehole 503. Drill pipe sections may be connected by a connection tool, such as connector 509. Connector 509 connects the lower end of drill pipe section 506 to a drill pipe section 511. The lower end of drill pipe section 511 is connected to a formation testing tool 512. The drill pipe section 511 acts as a "tool pusher" to assist movement and placement of the formation testing tool 512 downhole. The formation testing tool 512 may be a high flowrate formation tester, a vertical interference tester, or a mini-frac tool, as disclosed herein.

The system 500 also includes a logging facility 507 (shown in FIG. 5 as a truck, although it may be any other structure). The logging facility 507 may collect measurements from the formation testing tool 512, and may include computing facilities for controlling, processing, or storing the measurements gathered by the formation testing tool 512. The computing facilities may be communicatively coupled to the formation testing tool 512 by way of a wireline cable 508. The logging facility 507 may include drawworks or other means for allowing the wireline cable 508 to roll and unroll during operations. Wheels 513A and 513B connect the wireline cable 508 to the derrick 501 while still allowing for movement of the wireline cable 508. The wireline cable 508 is initially positioned outside the drill pipe sections. A cut out 510 in the connector 509 allows for the wireline cable 508 to be inserted through a sealing element to the inside of the drill pipe and remain inside the drill pipe below that point. The connector 509 and the cut out may be a side entry sub or other connection tool suitable for allowing a wireline able to enter a drill pipe downhole, while maintaining a pressure seal across the entry point. The wireline cable 508 then connects to the formation testing tool 512 inside the drill pipe section 511.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

Figure 6:
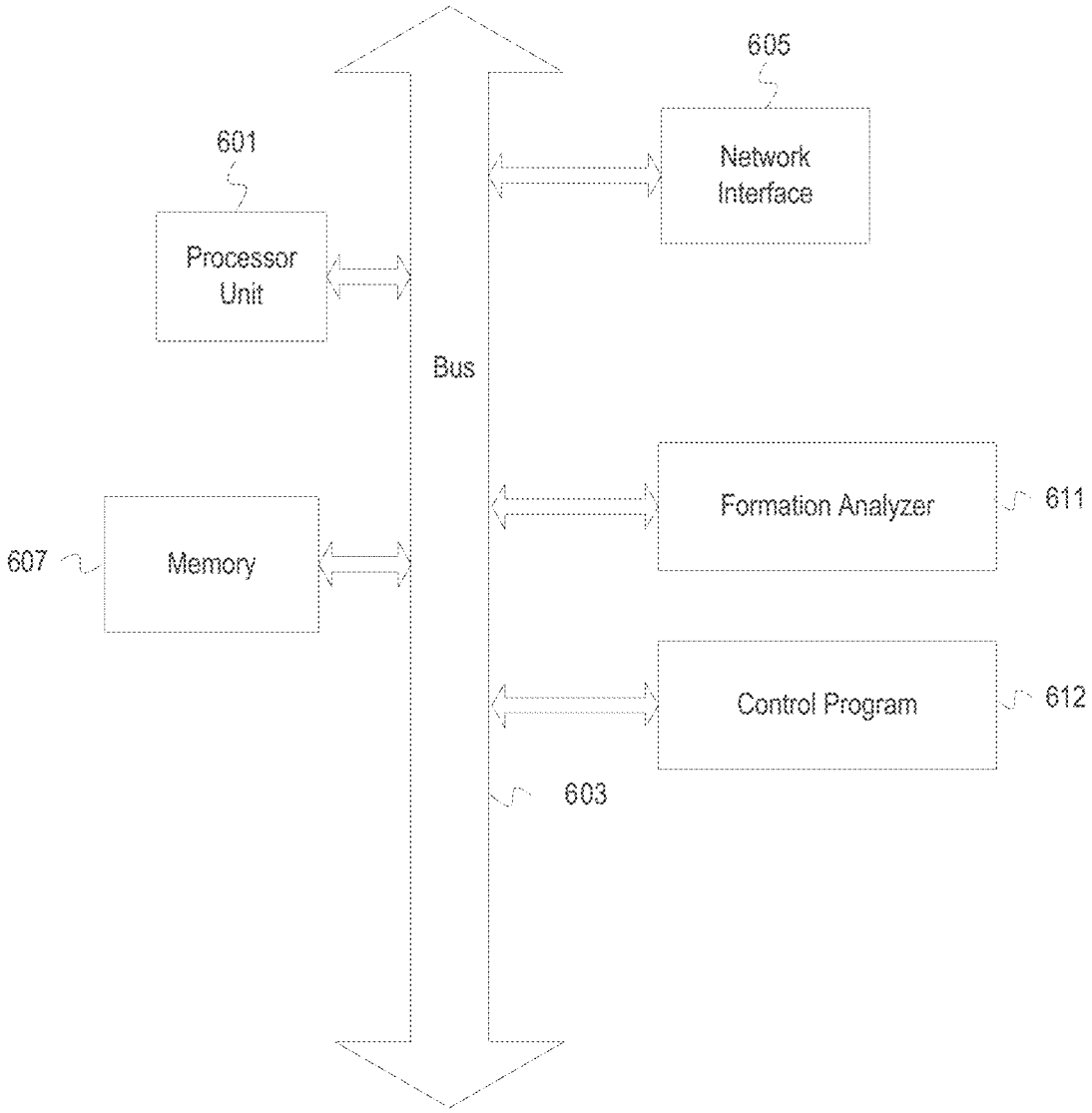
FIG. 6 is an example system for formation testing.

FIG. 6 depicts an example computer system for high flowrate formation testing. The computer system includes a processor 601 (possibly including multiple processors, multiple cores, multiple nodes, and/or implementing multithreading, etc.). The computer system includes memory 607. The memory 607 may be system memory or any one or more of the above already described possible realizations of machine-readable media. The computer system also includes a bus 603 and a network interface 605. The system communicates via transmissions to and/or from remote devices via the network interface 605 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.). The system also includes a formation analyzer 611 and a control program 612. The formation analyzer 611 communicates with a reservoir description tool string of a formation tester to perform reservoir analysis. The control program 612 may control the circulation rate of the drilling fluid into the formation tester. Any one of the previously described functionalities may be partially (or entirely) implemented in hardware and/or on the processor 601. For example, the functionality may be implemented with an application specific integrated circuit, in logic implemented in the processor 601, in a co-processor on a peripheral device or card, etc. Further, realizations may include fewer or additional components not illustrated in FIG. 6 (e.g., video cards, audio cards, additional network interfaces, peripheral devices, etc.). The processor 601 and the network interface 605 are coupled to the bus 603. Although illustrated as being coupled to the bus 603, the memory 607 may be coupled to the processor 601.

While the aspects of the disclosure are described with reference to various implementations and exploitations, it will be understood that these aspects are illustrative and that the scope of the claims is not limited to them. In general, techniques for high flowrate formation testing as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example Embodiments

An apparatus comprises an upper assembly. An impeller assembly is connected to a lower portion of the upper assembly. The impeller assembly comprises a first impeller connected to a second impeller through a shaft located longitudinally within the apparatus. The apparatus comprises a first flowline comprising a first end having an opening to a borehole and a packing device that isolates a portion of the borehole surrounding the first end of the first flowline from the rest of the borehole. A tool string is connected to the first flowline. The tool string hydraulically connects the packing device to the upper assembly.

The tool string further comprises modules for analyzing fluid formation properties. The modules comprise at least one of a pump, a fluid identification module, a module for storing sample chambers, a reservoir description module, a power and telemetry module, and an inverted wireline logging head.

The first impeller transfers mechanical power to operate the second impeller through the shaft. A valve is located along the flowline between the first end and the second impeller to control a flow rate of the formation fluid based on the mechanical power.

The apparatus further comprises a valve along a second flowline connected to the first flowline to isolate the formation fluid in an area of the apparatus. The first flowline has a larger diameter than the second flowline. The larger diameter enables increased fluid circulation.

The tool string further comprises valves to inflate the packing device to isolate the portion of the borehole surrounding the first end of the first flowline from the rest of the borehole.

The apparatus further comprises a gauge for monitoring pressure of the formation fluid from the isolated portion of the borehole.

A system comprises a pipe string, a wireline cable run through the pipe string, and a downhole tool for formation testing. The downhole tool comprises an upper assembly and an impeller assembly connected to a lower portion of the upper assembly. The impeller assembly comprises a first impeller coupled to a second impeller by a shaft, a first flowline having a first end that is open to the formation, a packing device that isolates a portion of a borehole surrounding the first end of the first flowline from the rest of the borehole, and a tool string connected to the first flowline. The tool string hydraulically connects the packing device to the upper assembly.

The tool string further comprises modules for analyzing the formation fluid properties. The modules comprise at least one of a pump, a fluid identification module, a module for storing and retrieving fluid samples, a reservoir description module, a power and telemetry module, and an inverted wireline logging head.

The wireline cable is connected to the upper assembly through a wet-connect latch.

The impeller assembly comprises electrical connections suitable for routing the wireline cable to the tool string.

The first impeller transfers the mechanical power to operate the second impeller through the shaft which is located longitudinally within the downhole tool.

A valve along the first flowline is positioned between the first end and the second impeller to control a flow rate of the formation fluid based on the mechanical power.

The system further comprises a valve along a second flowline connected to the first flowline to isolate the packing device from the rest of the downhole tool and from the wellbore.

The first flowline has a larger diameter than the second flowline. The larger diameter produces a lower pressure drop to enable increased fluid circulation.

The system further comprises a third flowline connected to the packing device via a valve to inflate the packing device. A diameter of the third flowline is less than a diameter of the first flowline. The third flowline branches off the first flowline.

A method comprising circulating drilling fluid into an annulus of a downhole tool. Hydraulic power from the circulated drilling fluid generates torque of a first impeller of a flowrate formation tester. The torque of the first impeller drives a second impeller. The method comprises drawing formation fluids into flowlines of the flowrate formation tester from driving the second impeller.

The method further comprises collecting samples of the formation fluid as the formation fluid is drawn through the flowlines.

The method further comprises recording a pressure response to a dynamic change in a flowrate of the formation fluid drawn into the flowlines of the flowrate formation tester and analyzing the pressure response.

The invention claimed is:

1. An apparatus comprising:

an upper assembly;

an impeller unit connected to a downhole end of the upper assembly, wherein the impeller unit comprises a first impeller connected to a second impeller through a shaft located longitudinally within the apparatus;

a first flowline comprising a first end having an opening to a borehole;

a packer unit that isolates a portion of the borehole surrounding the first end of the first flowline from the rest of the borehole; and a tool string connected to the first flowline, wherein the tool string hydraulically connects the packer unit to the upper assembly.

2. The apparatus of claim 1, wherein the tool string further comprises valves to inflate the packer unit to isolate the portion of the borehole surrounding the first end of the first flowline from the rest of the borehole.

3. The apparatus of claim 1, further comprising a gauge for monitoring pressure of the formation fluid from the isolated portion of the borehole.

4. The apparatus of claim 1, wherein the tool string further comprises modules for analyzing fluid formation properties, wherein the modules comprise at least one of a pump, a fluid identification module, a module for storing sample chambers, a reservoir description module, a power and telemetry module, and an inverted wireline logging head.

5. The apparatus of claim 1, wherein the first impeller transfers mechanical power to operate the second impeller through the shaft.

6. The apparatus of claim 5, further comprising a valve located along the first flowline between the first end and the second impeller to control a flow rate of formation fluid based on the mechanical power.

7. The apparatus of claim 1, further comprising a valve located along a second flowline connected to the first flowline to isolate formation fluid in an area of the apparatus.

8. The apparatus of claim 7, wherein the first flowline has a larger diameter than the second flowline, and wherein the larger diameter enables increased fluid circulation.

* * * * *